US011433513B2

(12) United States Patent
Hu

(10) Patent No.: US 11,433,513 B2
(45) Date of Patent: Sep. 6, 2022

(54) MULTIFUNCTIONAL TORQUE WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 640 days.

(21) Appl. No.: 16/504,394

(22) Filed: Jul. 8, 2019

(65) Prior Publication Data

US 2020/0156223 A1 May 21, 2020

(30) Foreign Application Priority Data

Nov. 21, 2018 (TW) ..... 107141496

(51) Int. Cl.
*B25B 23/00* (2006.01)
*B25B 23/142* (2006.01)

(52) U.S. Cl.
CPC ..... *B25B 23/0028* (2013.01); *B25B 23/0078* (2013.01); *B25B 23/1427* (2013.01)

(58) Field of Classification Search
CPC ..... B25B 23/0028; B25B 23/0078; B25B 23/1427
USPC ..... 173/862.21, 862, 22, 862.23
See application file for complete search history.

(56) References Cited

U.S. PATENT DOCUMENTS 2,934,946 A * 5/1960 Engquist ..... B25B 23/1427 73/862.21
3,678,744 A * 7/1972 Blattner ..... B25B 23/1427 73/862.23
3,911,736 A * 10/1975 Miller ..... B25B 23/1427 73/862.321
8,505,419 B2 * 8/2013 Cheng ..... B25G 1/063 81/177.85

* cited by examiner

*Primary Examiner* — Hadi Shakeri
(74) *Attorney, Agent, or Firm* — WPAT, PC

(57) ABSTRACT

A multifunctional torque wrench includes a main body, an operation member, and an indication device. The main body has a driving portion, a combination portion, and a twisting portion. The driving portion pivotally drives a fastener to rotate about an axis passing through the main body. The operation member is switchable between a first position and a second position with respect to the main body. The extension portion extends along a second axis. When the operation member is at the first position, the second axis is vertical to the first axis, allowing a user to turn the main body to generate the torque for driving a fastener. The indication device is disposed between the main body and the operation member for displaying the torque value. When the operation member is at the second position, the second axis is parallel to the first axis for storage.

18 Claims, 12 Drawing Sheets

MULTIFUNCTIONAL TORQUE WRENCH

BACKGROUND OF THE INVENTION

1. Field of the Invention

The present invention relates to torque wrenches, and more particularly, to a multifunctional torque wrench.

2. Description of the Related Art

Referring to FIG. 1, a conventional torque wrench 1 for bicycle maintenance is provided, comprising a handle 2 and a hexagonal wrench 3. The hexagonal wrench 3 has one end disposed on the handle 2, such that the torque wrench 1 is present in a T shape. The hexagonal wrench 3 has another end provided with a socket head 4, so that the user is allowed to twist the hexagonal wrench 3 by turning the handle 2, whereby the socket head 4 drives the mounted screw or driver head to rotate (not shown). The torque wrench 1 has a point member 5 and an indication panel 6. When the hexagonal wrench 3 is twisted by the user turning the handle 2, the point member 5 moves with respect to the indication panel 6 for pointing at the corresponding scale on the indication panel 6, so as to acquire the torque imposed by the socket head 4 on the fastener. Based on the fact that a higher priced bicycle frame (especially carbon-fiber frame) has a torque limitation provided by safety screws, such conventional torque wrench 1 is applied for protecting the carbon-fiber bicycle frame, so as to prevent the higher priced bicycle from breaking due to an overly imposed screwing torque.

The aforementioned convention torque wrench 1 has the point member 5 for pointing out the scale on the indication panel 6 for displaying the torque value for fastening the bicycle screw. However, due to the structural limitation, the conventional torque wrench 1 merely achieves a singular function. In the bicycle industry, such product will be possibly purchased only by the professional mechanic of a maintenance plant, unable to be distributed to general customers. In other words, the conventional torque wrench 1 fails to attract ordinary customers due to the lack of additional functions. Therefore, it is desirable to provide a multifunctional torque wrench which will be popular among general customers in the bicycle industry.

SUMMARY OF THE INVENTION

For improving the issues above, a multifunctional torque wrench is disclosed. With the operation member being switched between a first position and the second position with respect to the main body, when the operation member is at the first position, the extension portion allows the user to slightly turn the main body for generating the rotation torque with respect to the main body, so as to drive the fastener and display the torque value through the indication device. When the operation member is at the second position, the extension portion is arranged in parallel to the axis of the main body.

For achieving the aforementioned objectives, a multifunctional torque wrench is provided, comprising:

a main body having a driving portion, a combination portion, and a twisting portion disposed between the driving portion and the combination portion, the main body having a first axis passing through the driving portion, such that the driving portion pivotally drives a fastener to rotate about the axis;

an operation member having a connection portion and an extension portion connected with the connection portion, the connection portion being combined with the combination portion of the body, the operation member being switched between a first position and a second position with respect to the main body, the extension portion extending along a second axis; when the operation member is at the first position, the second axis is arranged in vertical to the first axis, allowing a user to slightly turn the main body to generate the torque for driving the fastener; when the operation member is at the second position, the second axis is arranged in parallel to the first axis for facilitating the convenience of storage for the user; and an indication device disposed between the main body and the operation member for displaying a value corresponding to the torque.

With such configuration, the operation member is switchable between different positions with respect to the main body. When the operation member is at the first position, the extension portion is turned to rotate with respect to the main body, so as to drive the fastener for fastening or loosening, with the torque displayed by the indication device. When the wrench is to be stored, the operation member is switched to the second position, the second axis of the extension portion is in parallel to the first axis of the main body, so as to minimize the volume of the operation member and the main body, facilitating the convenience of storage.

Also, when the operation member is at the second position with respect to the main body, with the second axis of the extension portion arranged in parallel to the first axis of the main body, besides meeting the convenience of storage, the torque value during fastening or loosening the fastener is displayed by the indication device. Therefore, the wrench is able to drive the fastener at both the first position and the second position, facilitating the convenience of usage.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Figure 1:
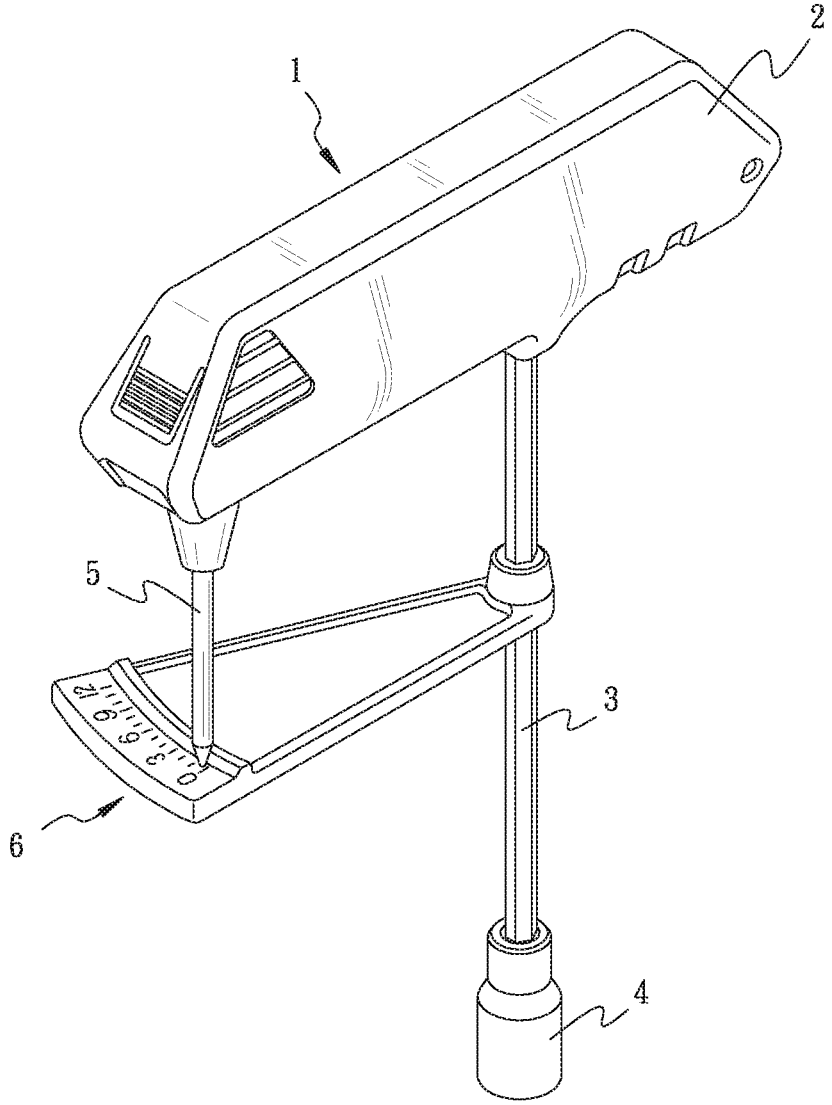
PRIOR ART FIG. 1
FIG. 1 is a perspective view of a conventional torque wrench.
Figure 2:
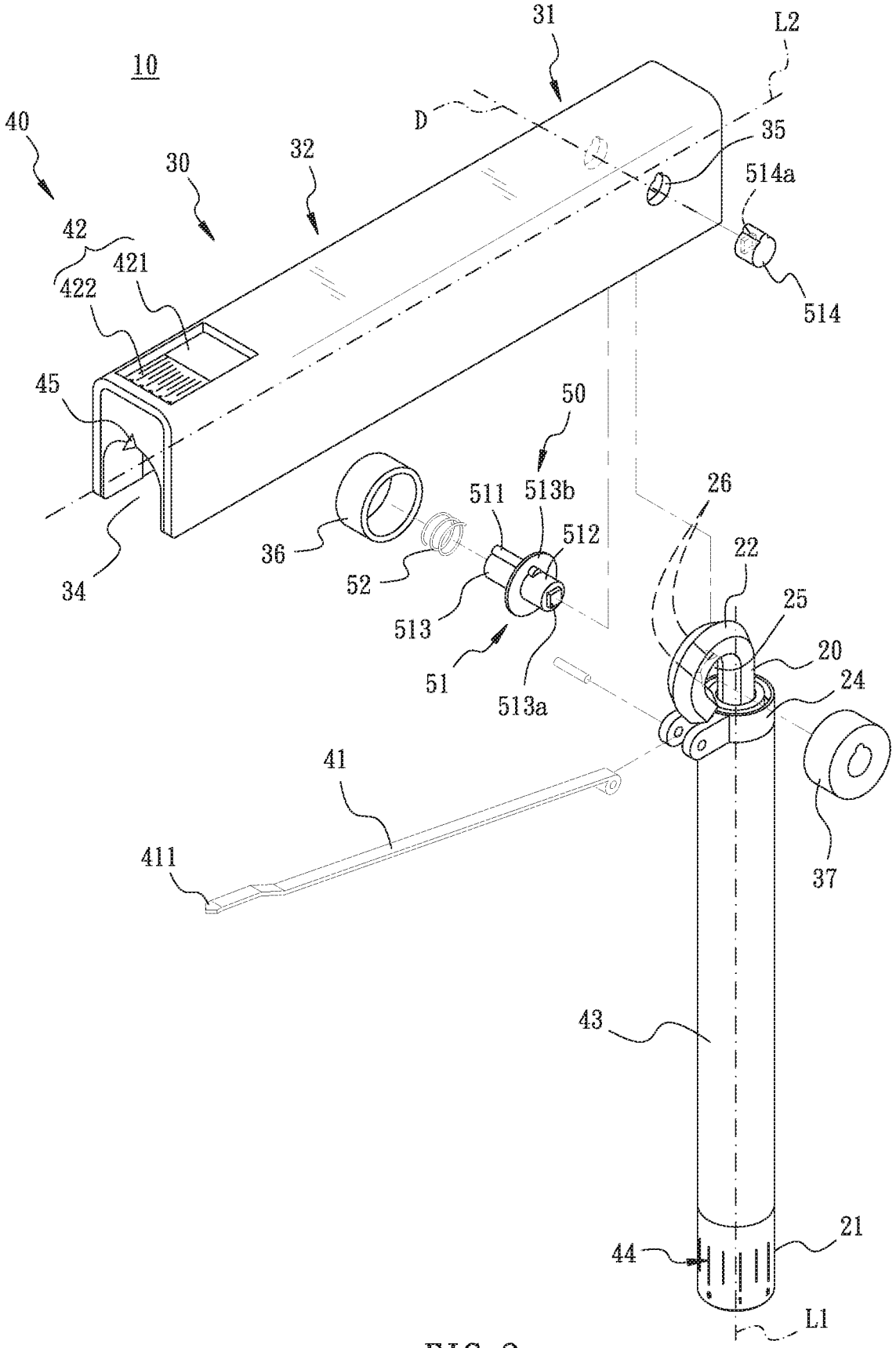
FIG. 2 is an exploded view of the multifunctional torque wrench in accordance with the first embodiment of the present invention.
Figure 3:
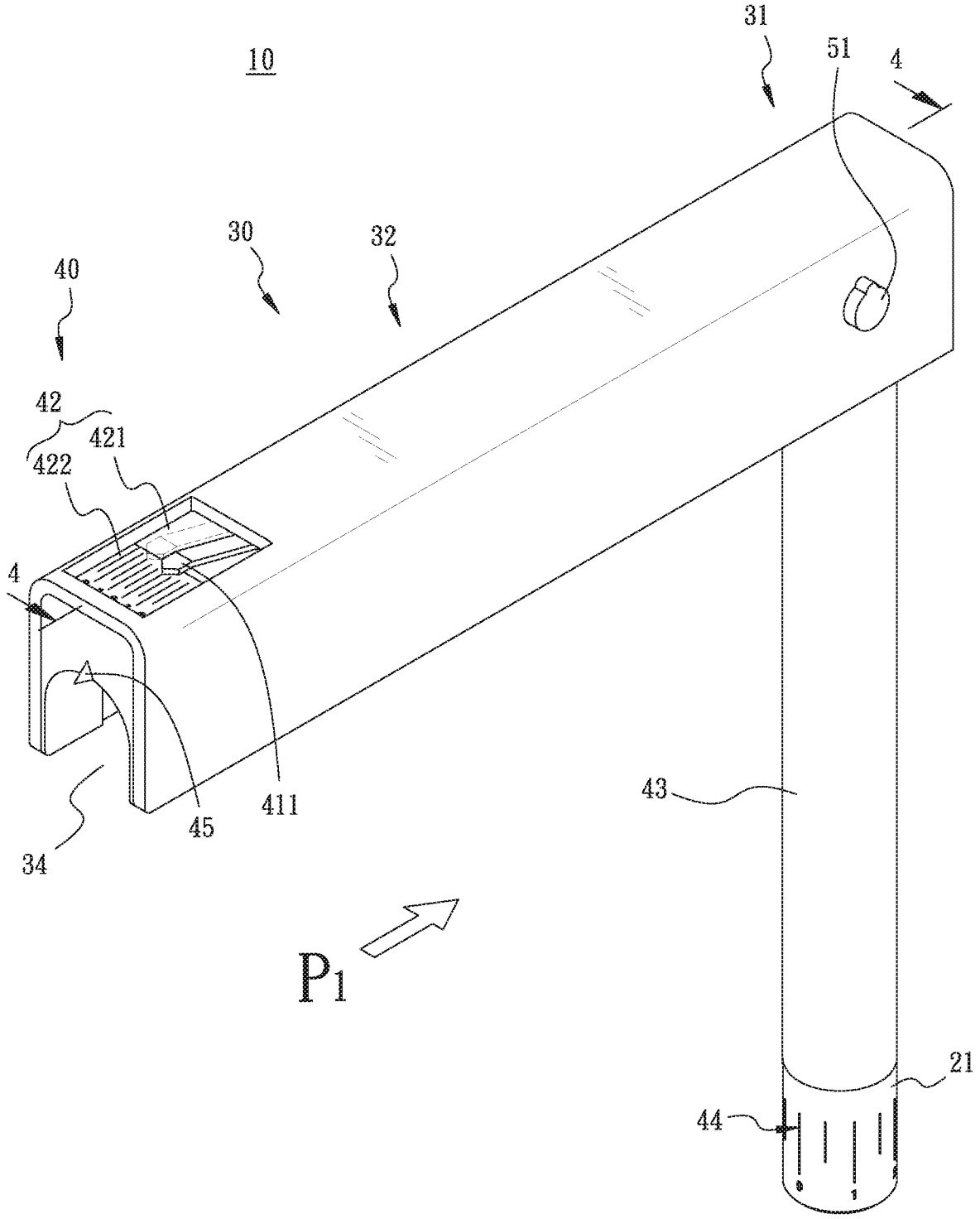
FIG. 3 is a perspective view of the multifunctional torque wrench in accordance with the first embodiment of the present invention at the first position.
Figure 4:
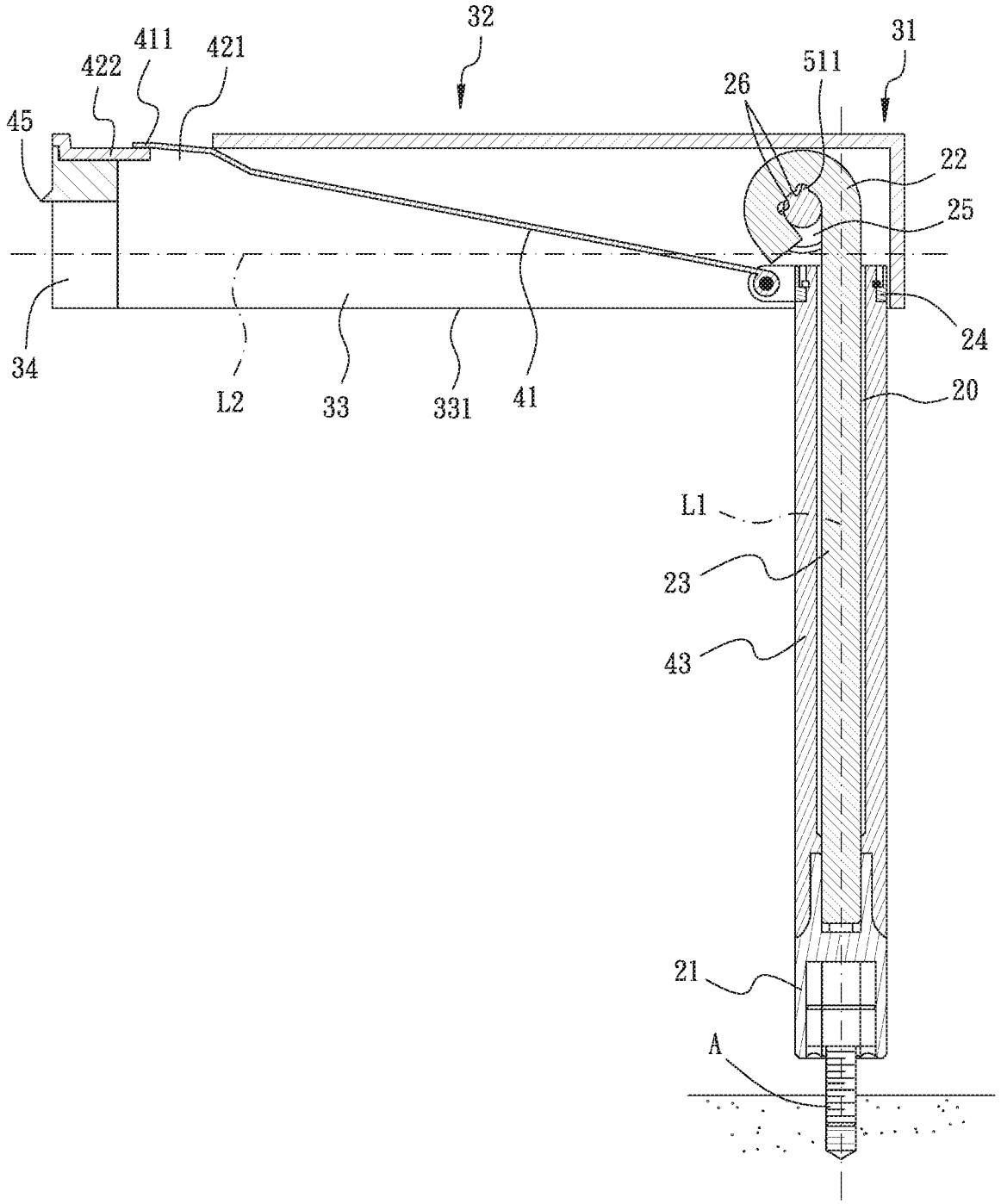
FIG. 4 is a cross-sectional view taken along line 4-4 in FIG. 3.

Referring to FIG. 2 to FIG. 9, the first embodiment of the multifunctional torque wrench 10 comprises a main body 20, an operation member 30, and an indication device 40. The multifunctional torque wrench 10 is applied for driving a fastener A (as shown by FIG. 4).

The main body 20 has a driving portion 21, a combination portion 22, and a twisting portion 23 disposed between the driving portion 21 and the combination portion 22. The main body 20 has a first axis L1 passing through the driving portion 21, such that the driving portion 21 drives the fastener A about the first axis L1.

Figure 5:
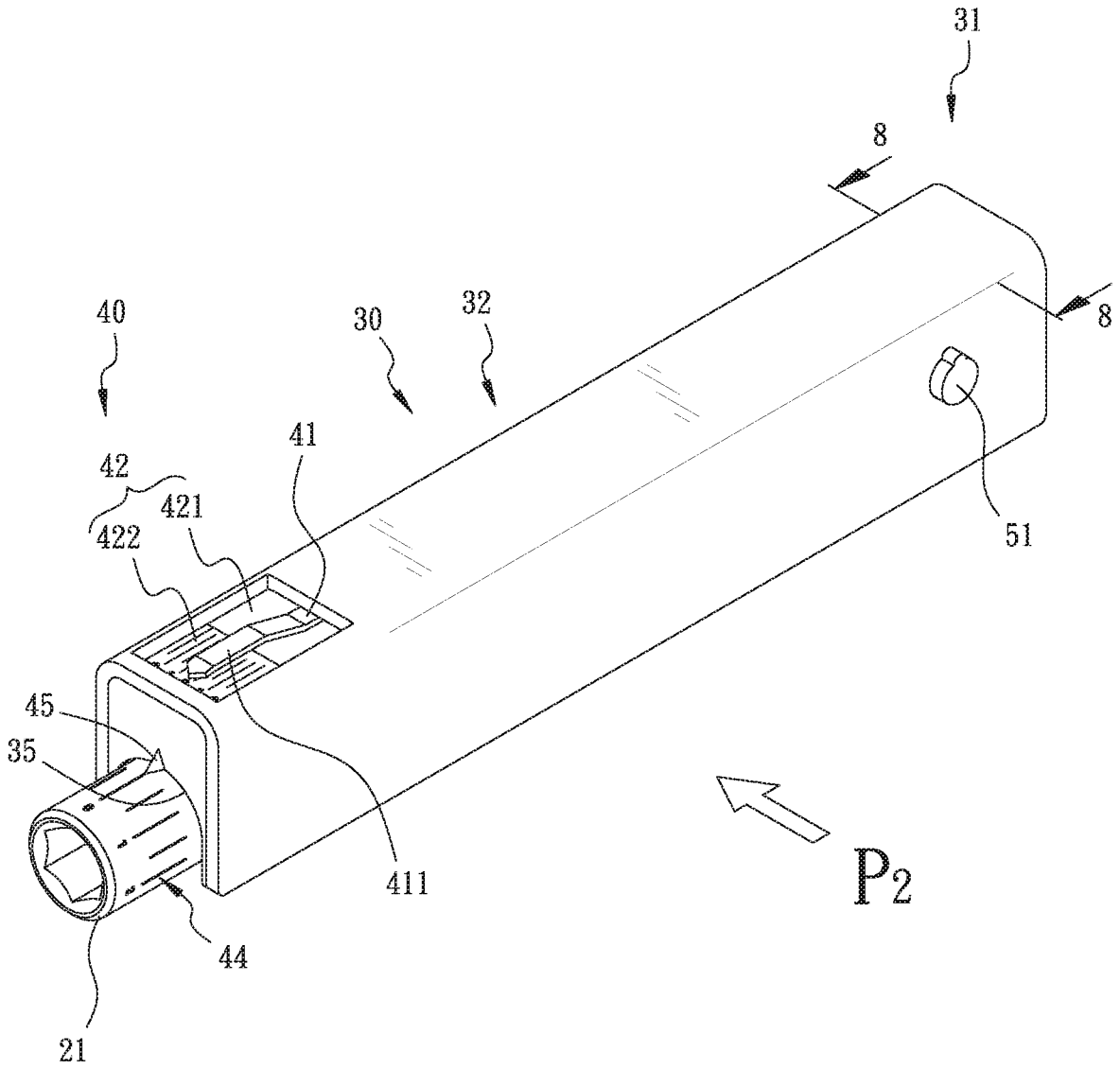
FIG. 5 is a perspective view of the multifunctional torque wrench in accordance with the first embodiment of the present invention at the second position.
Figure 6:
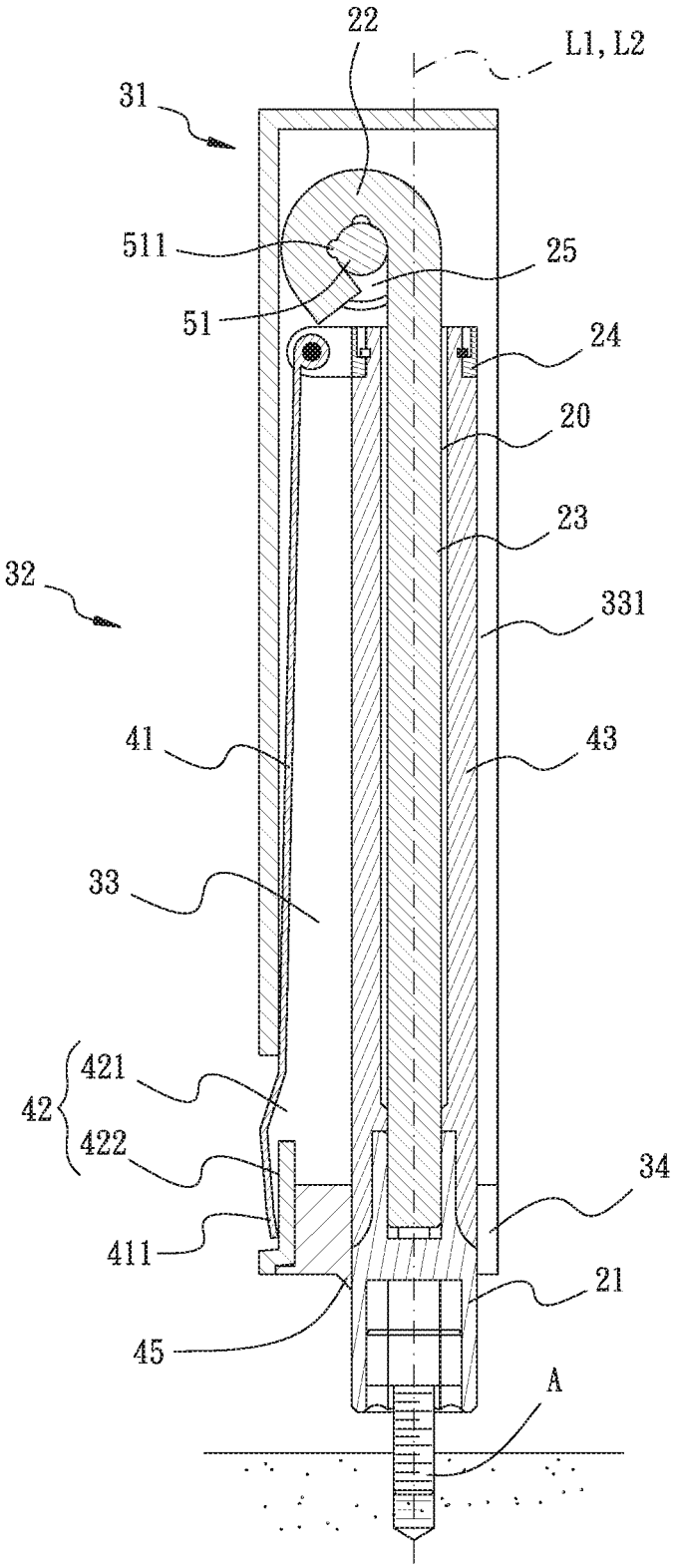
FIG. 6 is a sectional view of the multifunctional torque wrench in accordance with the first embodiment of the present invention at the second position.

The operation member 30 has a connection portion 31 and an extension portion 32 connected with the connection portion 31. The connection portion 31 is connected with the combination portion 22 of the main body 20, such that the operation member 30 is able to be switched between the first position P1 (as shown by FIG. 3 and FIG. 4) and a second position P2 (as shown by FIG. 5 and FIG. 6). The extension portion 32 extends along a second axis L2. When the operation member 30 is at the first position P1, the second axis L2 is vertical to the first axis L1, and the user is allowed to slightly turn the main body 20 to generate a rotation torque for driving the fastener A (as shown by FIG. 4). When the operation member 30 is at the second position P2, the second axis L2 is in parallel to the first axis L1, facilitating the convenience of storage.

The operation member 30 is a hollow casing having a groove 33. The groove 33 has one side thereof opened to form an opening 331. The combination portion 22 and the connection portion 31 are pivotally connected with a pivot device 50 in the groove 33. The main body 20 is able to pivot out of the groove 33 from the opening 331, and the first position P1 is defined as the status of the second axis L2 being vertical to the first axis L1. Also, the main body 20 is able to pivot into the groove 33 from the opening 331, and the second position P2 is defined as the status of the second axis L2 being in parallel to the first axis L1. In an embodiment of the present invention, when the main body 20 pivots into the groove 33 at the second position P2, and the second axis L2 is in parallel to the first axis L1, the length along the longitudinal direction of the main body 20 is greater than the length along the longitudinal direction of the operation member 30, such that the driving portion 21 is able to accommodate the fastener A for driving the fastener A (as shown by FIG. 6).

The indication device 40 is disposed between the main body 20 and the operation member 30 for displaying the corresponding torque value. The indication device 40 has a first indication portion and a second indication portion arranged between the main body 20 and the operation member 30. When the twisting portion 23 of the main body 20 is twisted, the first indication portion and the second indication portion are linked to move with respect to each other, so as to display the corresponding torque value. As shown by FIG. 2, regarding the indication device 40 in the embodiment, the first indication portion includes a pointer 41 and a window 42. The pointer 41 is disposed in the groove 33 and has one end pivotally connected to the main body 20 in adjacent to the combination portion 22. Also, the other end of the pointer 41 has an indication end 411. The window 42 is disposed on the operation member 30 and has an aperture 421 and a mark portion 422. The mark portion 422 has a torque value mark which is displayed with a scale. The indication end 411 protrudes through the aperture 421 to resist against the mark portion 422. When the operation member 30 is at the first position P1 for turning the main body 20, the indication end 411 points at the corresponding torque value on the mark portion 422 (as shown by the indication end 411 presented in the broken line in FIG. 3). In the embodiment, the indication device 40 has an external member 43, and the main body 20 includes an adjustment seat 24. The adjustment seat 24 is rotatably disposed on the external member 43 in adjacent to the combination portion 22, with one end of the pointer 41 pivotally connected to the adjustment seat 24. The adjustment seat 24 is allowed to rotate with respect to the main body 20 to be positioned, so as to adjust the position on the mark portion 422 pointed by the indication end 411, wherein the position on the mark portion 422 initially pointed by the indication end 411 is defined as, for example, the zeroing position.

Figure 7:
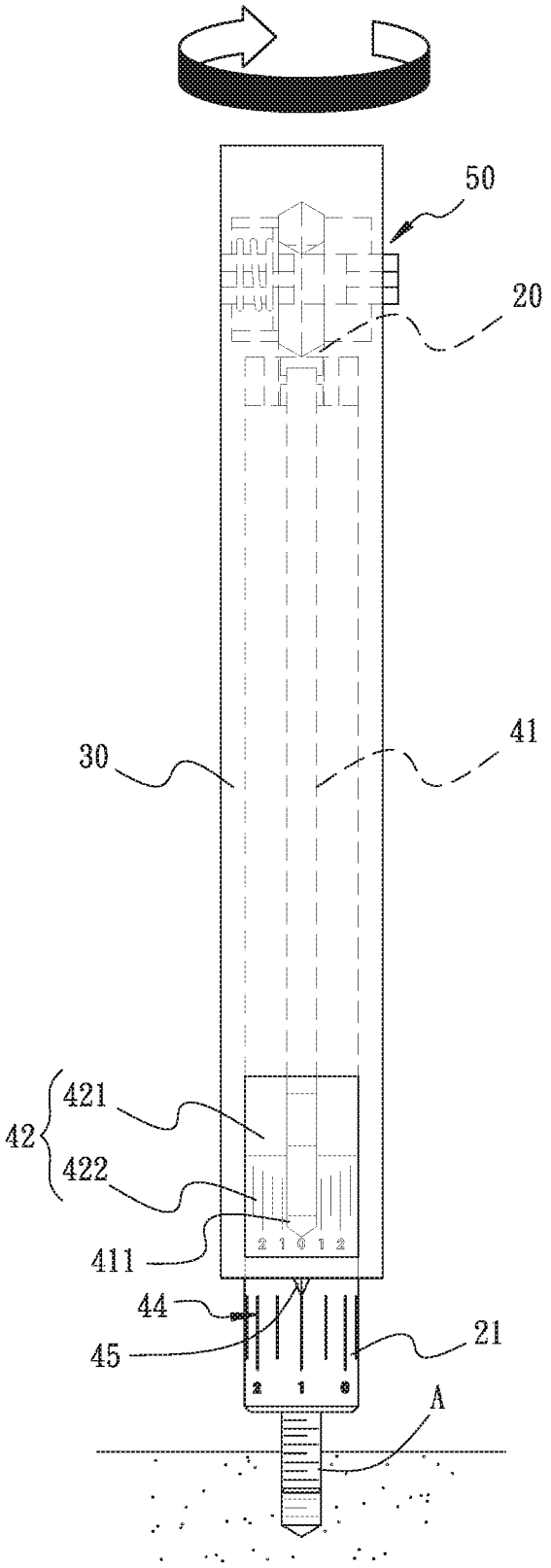
FIG. 7 is a schematic view illustrating the multifunctional torque value displayed by the indication device when the torque wrench is at the second position.

In the embodiment, the operation member 30 has a notch 34 formed on the extension portion 32 away from the connection portion 31, so that at the second position P2, the driving portion 21 is exposed out of the operation member 30 from the notch 34. The second indication portion of the indication device 40 includes a mark portion 44 and an indicator 45. The mark portion 44 is disposed on a portion of the driving portion 21 which is exposed from the notch 34, and the indicator 45 is disposed on one end of the operation member 30 having the notch 34. The mark portion 44 has a torque value mark surrounding the driving portion 21, wherein the torque value is presented as a scale. When the driving portion 21 is exposed from the notch 34 at the second position P2, and the operation member 30 turns the main body 20 at the second position P2 to generate the torque, the indicator 45 points at the corresponding torque value on the mark portion 44 (as shown by FIG. 7).

Figure 8:
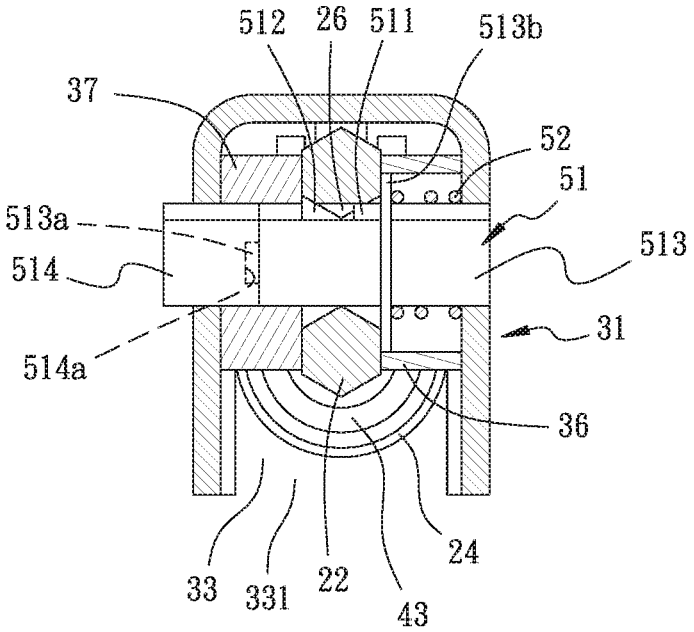
FIG. 8 is a cross-sectional view taken along line 8-8 in FIG. 5.
Figure 9:
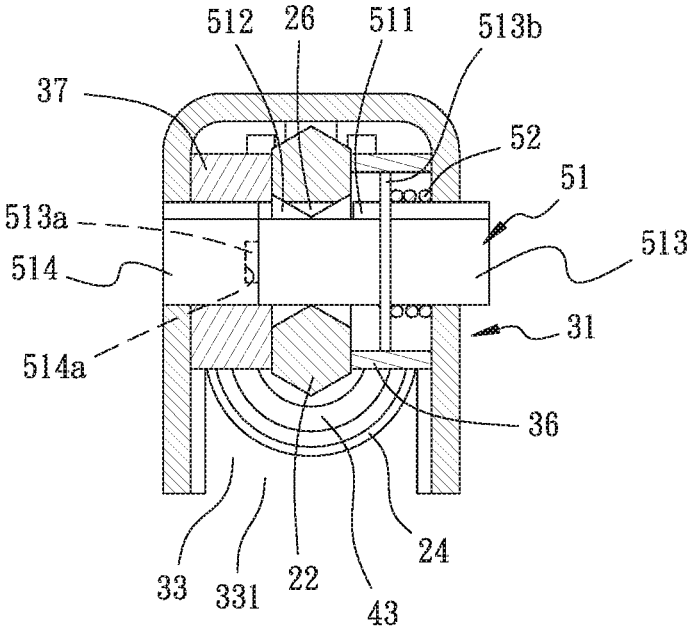
FIG. 9 is a schematic view illustrating the status of the pivot device of FIG. 8 after being operated.

In the embodiment, the pivot device 50 includes a shaft 51. The shaft 51 has a length greater than the width of the groove 33, and is combined in a through hole 35 of the operation member 30, such that the shaft 51 is allowed to slide along an axial direction D with respect to the through hole 35. The shaft 51 has a protrusion section 511 radially protruding and an avoidance section 512 concave with respect to the protrusion section 511. The main body 20 has a pivot hole 25 disposed on the combination portion 22, so that the shaft 51 passes through the pivot hole 25. Two position limiting grooves 26 are formed on the inner side of the pivot hole 25 on the combination portion 22, such that the two position limiting grooves 26 are applied for engaging and fixing the protrusion section 511 when the main body 20 and the operation member 30 are at the first position P1 and the second position P2, respectively (as shown by FIG. 8). Also, when the shaft 51 slides along the axial direction D, the avoidance section 512 faces the position limiting groove 26 for cancelling the engagement between the main body 20 and the operation member 30 (as shown by FIG. 9), so that the main body 20 is able to pivot into or out of the groove 33 with respect to the operation member 30. Preferably, in the embodiment, the pivot device 50 further includes an elastic member 52, which has two ends thereof resisting against the shaft 51 and the operation member 30, respectively, such that the shaft 51 is allowed to be restored to the original position after sliding along the axial direction D with respect to the through hole 35.

Also, in the embodiment, the main body 20 is a rod body having a sectional profile formed in a hexagonal shape, and the combination portion 22 is formed by one end of the main body 20 which is curved to form the pivot hole 25. In addition, the shaft 51 is formed by a combination of a first shaft section 513 and a second shaft section 514. In the embodiment, the first shaft section 513 has one end provided with a protrusion portion 513*a*, and the second shaft section 514 has one end provided with a concave portion 514*a*, wherein the protrusion portion 513*a* and the concave portion 514*a* are formed in a non-circular shape (rectangular shape in the embodiment) and combined in a concave-convex combination manner, so that the first shaft section 513 and the second shaft section 514 do not rotate with respect to each other.

Further, the operation member 30 has a first sleeve ring 36 and a second sleeve ring 37 disposed on two opposites sides in the groove 33. In the groove 33, two ends of the shaft 51 pass through the first sleeve ring 36 and the second sleeve ring 37, respectively, wherein the shaft 51 has a block portion 513*b* radially protruding on the first shaft section 513 and placed in the first sleeve ring 36. The elastic member 52 in the first sleeve ring 36 has two ends resisting against the block portion 513*b* and the operation member 30. With the function of the elastic member 52, the shaft 51 is restored back to the original position after being pressed to slide along the axial direction D pressed, so as to restore the positional engagement between the protrusion section 511 and the position limiting groove 26.

In the embodiment, the pointer 41 simply passes through the aperture 421 to be resisted against the mark portion 422. Also, the pointer 41 is allowed to be embodied in different aspects.

Figure 10:
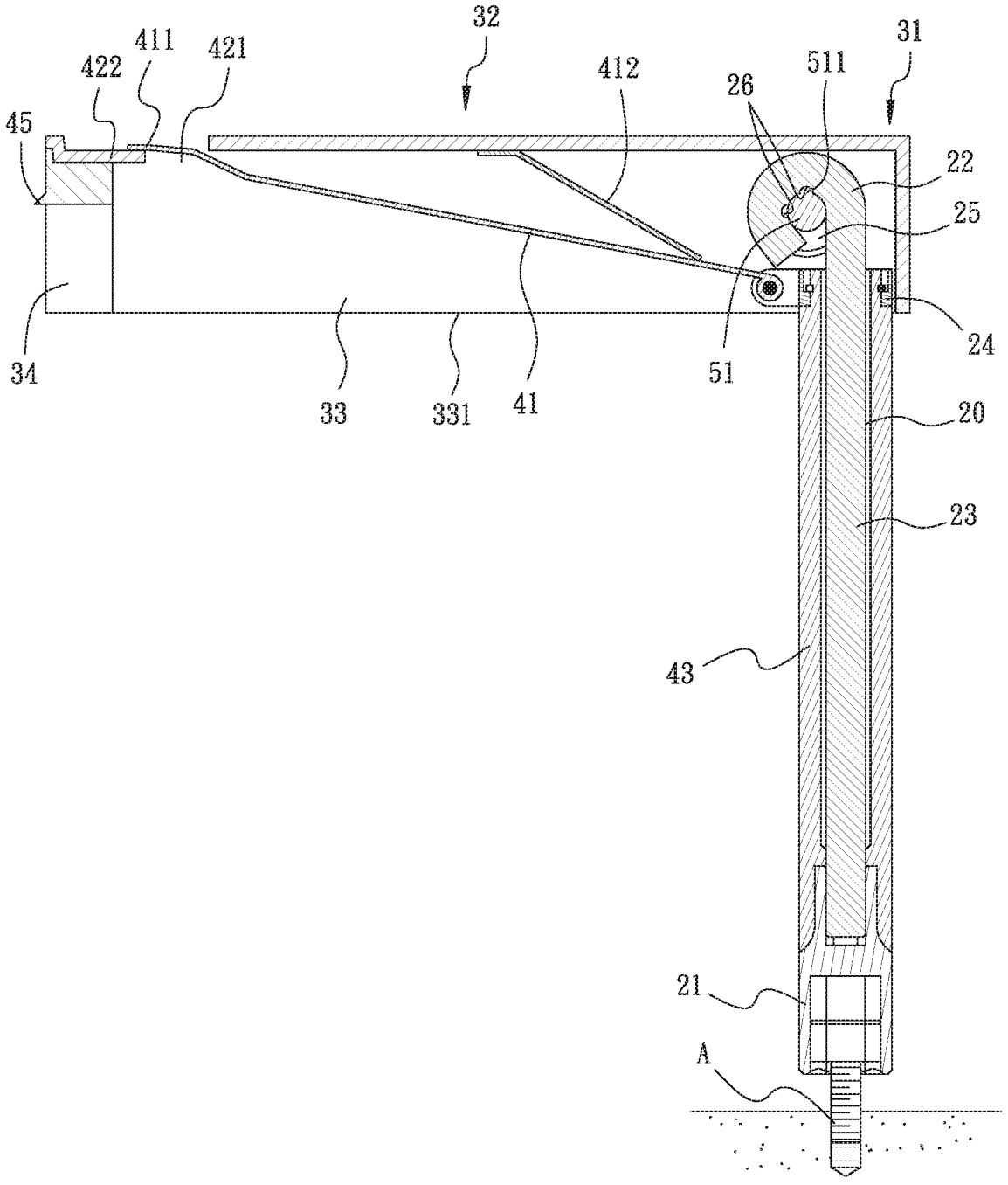
FIG. 10 is a sectional view of the multifunctional torque wrench in accordance with the second embodiment of the present invention at the first position.
Figure 11:
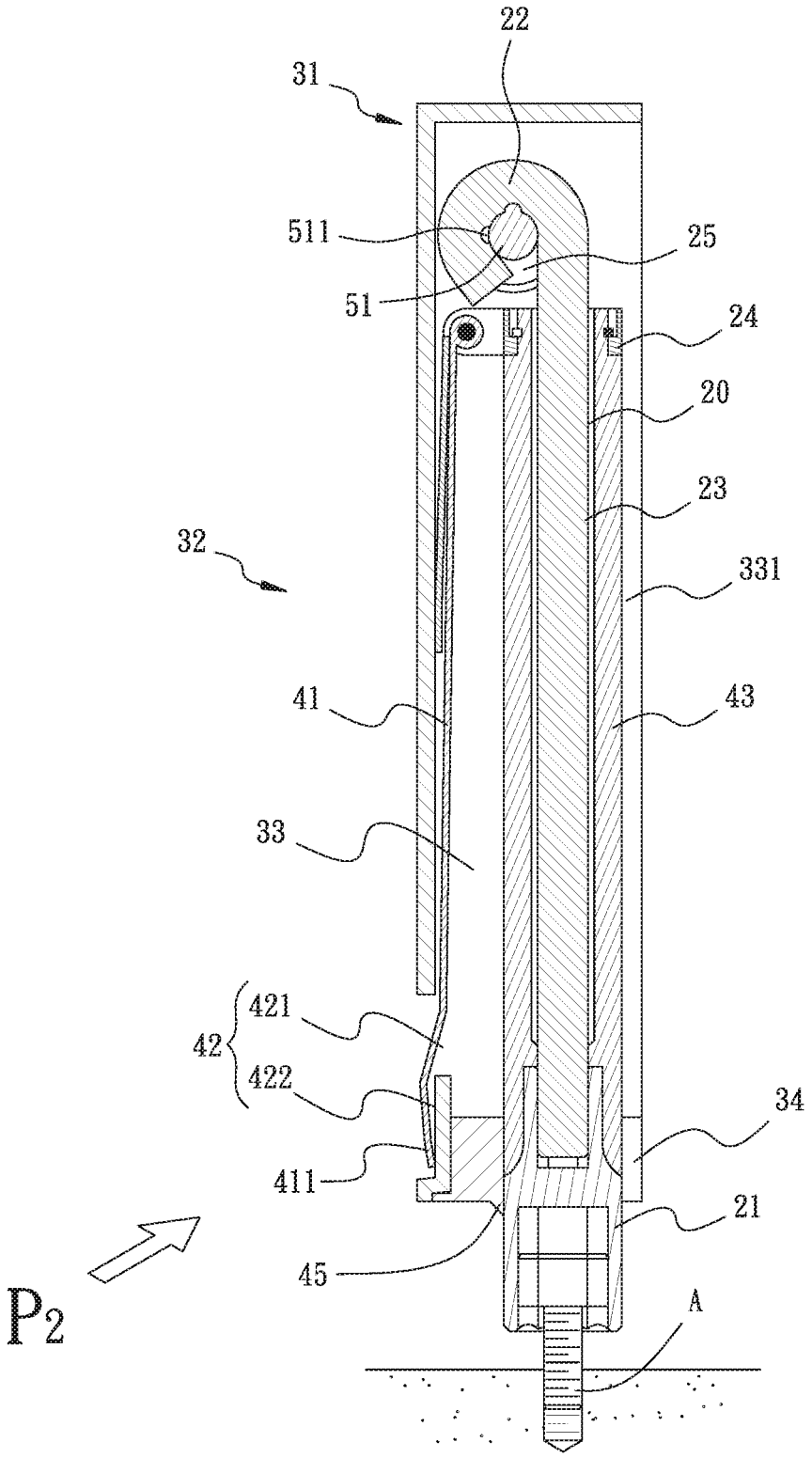
FIG. 11 is a sectional view illustrating the multifunctional torque wrench of FIG. 10 at the second position.

Referring to FIG. 10 and FIG. 11, the second embodiment of the multifunctional torque wrench 10 is illustrated. The pointer 41 has a resilient plate 412, and the pointer 41 is in the groove 33 and resisted by the resilient plate 412. The resilient plate 412 has one end connected with the extension portion 32 and raised along a slanting direction, with another end of the resilient plate 412 contacting the pointer 41 for resisting the pointer 41, whereby the pointer 41 is resisted by the resilient plate 412 for pressing the indication end 411 on the mark portion 422. Therefore, when the operation member 30 is at the first position P1 or the second position P2, the pointer 41 is maintained at the stable position, preventing a loosened or wavering possibility thereof.

Figure 12:
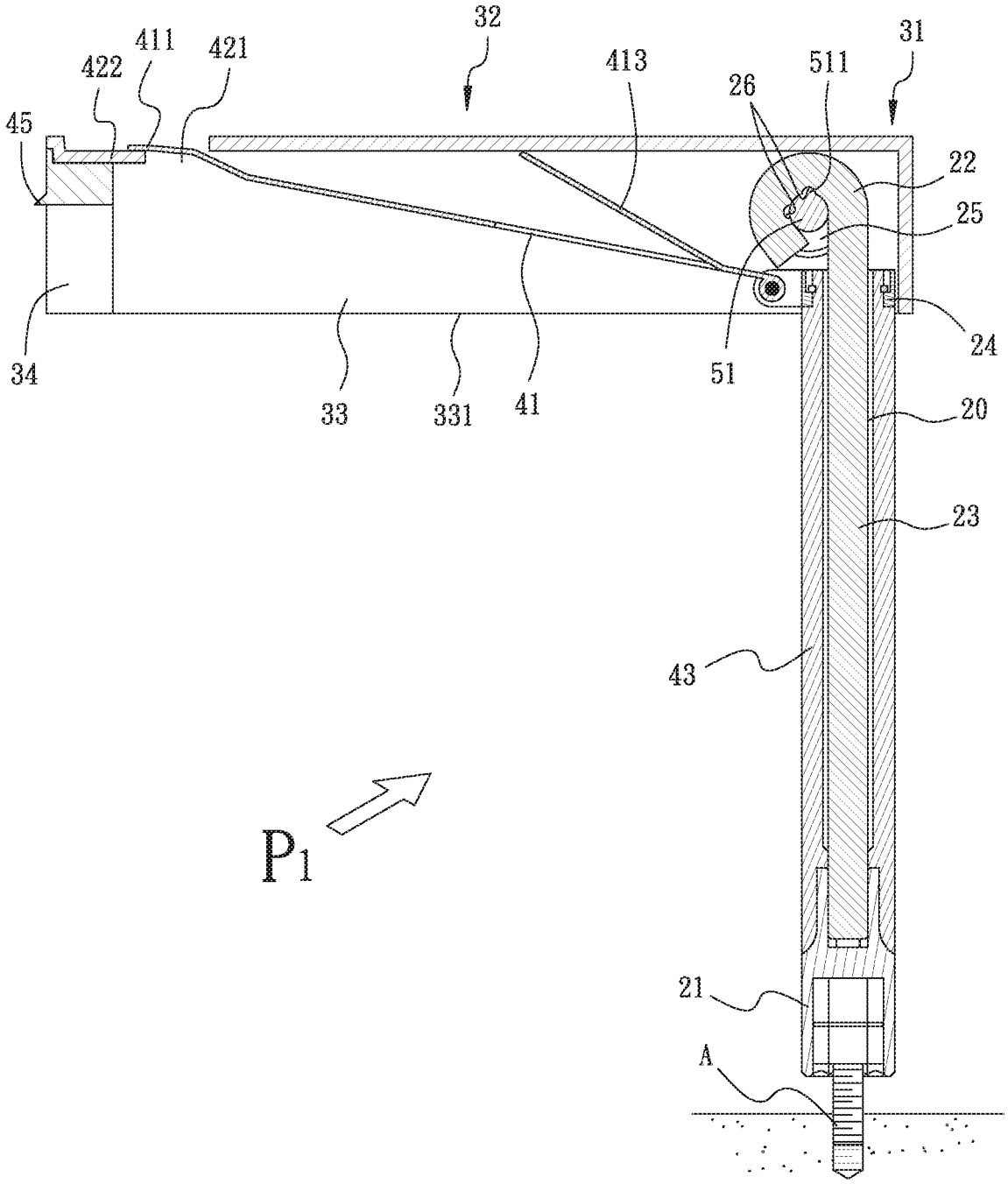
FIG. 12 is a sectional view of the multifunctional torque wrench in accordance with the third embodiment of the present invention at the first position.
Figure 13:
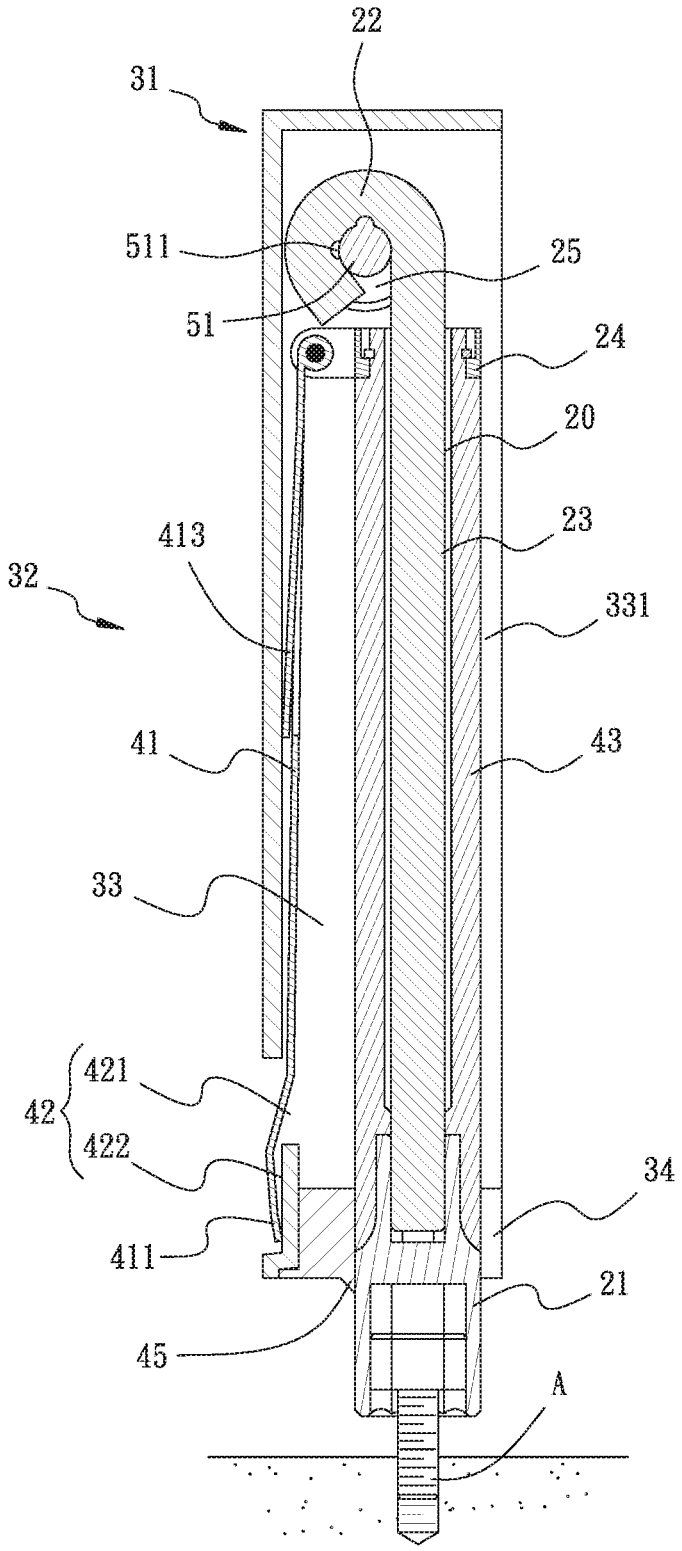
FIG. 13 is a sectional view of the multifunctional torque wrench of FIG. 12 at the second position.

Further referring to FIG. 12 and FIG. 13, the third embodiment of the multifunctional torque wrench 10 is illustrated. The pointer 41 further has a resilient plate 413, and the pointer 41 is in the groove 33 and resisted by the resilient plate 413. The resilient plate 413 has one end connected with the pointer 41 and raised along a slanting direction, with another end of the resilient plate 413 contacting the extension portion 32 for resisting the pointer 41, whereby the pointer 41 is resisted by the resilient plate 413 for pressing the indication end 411 on the mark portion 422. Therefore, when the operation member 30 is at the first position P1 or the second position P2, the pointer 41 is maintained at the stable position, preventing a loosened or wavering possibility thereof. Also, in the third embodiment, the resilient plate 413 is integrally formed on the pointer 41, so that the third embodiment is more economical than the second embodiment.

With the foregoing configuration, advantages of the present invention will be illustrated below.

The operation member 30 is switchable between the first position P1 and the second position P2 with respect to the main body 20. At the first position P1, the extension portion 32 is turned for generating the rotation torque for driving the fastener A. Therefore, the torque arm formed by the extension portion 32 is able to save the force imposed upon the fastener A for fastening or loosening the fastener A, and the torque value is displayed (as shown by FIG. 3 or FIG. 7) by the first indication portion (the pointer 41 and the window 42) of the indication device 40. When the wrench is to be stored, the main body 20 and the operation member 30 are switched to the second position P2, wherein the second axis L2 of the extension portion 32 is arranged in parallel to the first axis L1 of the main body 20. Compared with the first position P1, the volume occupied by the main body 20 and the operation member 30 at the second position P2 is effectively minimized, so as to more convenient for storage than the conventional T-shaped torque wrench.

When the operation member 30 is at the second position P2 with respect to the main body 20, and the second axis L2 of the extension portion 32 is arranged in parallel to the first axis L1 of the main body 20, besides the advantage of the storage convenience, driving the fastener A for fastening or loosening the fastener A in this status also allows the torque value to be displayed by the second indication portion (the mark portion 44 and the indicator 45) of the indication device 40. Therefore, the multifunctional torque wrench 10 is able to be applied for driving the fastener A at both the first position P1 and the second position P2, facilitating the convenience of usage.

Regarding the first indication portion of the indication device 40, the pointer 41 is disposed along the extension portion 32. When the extension portion 32 is turned at the first position P1, the pivoting range of the indication end 411 on the mark portion 422 is amplified. In other words, when the operation member 30 is applied for turning the main body 20 at the second position P2, if the indicator 45 of the second indication portion is able to enlarge the indicated torque value on the mark portion 44 by one time, the pointer 41 of the first indication portion is able to enlarge the indicated torque value on the mark portion 422 by two times. Therefore, the torque value is clearly presented.

The pointer 41 of the indication device 40 is placed in the operation member 30, with only the indication end 411 exposed from the aperture 421. Also, the indication end 411 is placed in the window 42. Compared with the conventional torque wrench whose point member 5 and the indication panel 6 are exposed, the overall volume of the multifunctional torque wrench 10 is reduced, and the pointer 41 is prevented from accidently hurting the user during the operation.

To sum up the advantages above, the multifunctional torque wrench 10 of the present invention is able to be applied for driving the fastener A at both the first position P1 and the second position P2, achieves a force saving effect for the user, and is convenient for storage at the second position P2. Further, the multifunctional torque wrench 10 of the present invention provides the function for driving the fastener A at the second position P2 as well, and the first indication portion and the second indication portion are able to enlarge the indicated torque value by two times and one time, respectively, thus emphasizing the multifunctional features of the present invention.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multifunctional torque wrench, comprising:

a main body having a driving portion, a combination portion, and a twisting portion disposed between the driving portion and the combination portion, the main body having a first axis passing through the driving portion, and the driving portion driving a fastener about the first axis;

an operation member having a connection portion and an extension portion connected with the connection portion, the connection portion connected with the combination portion of the main body, the operation member being switched between a first position and a second position, the extension portion extending along a second axis, wherein the main body is turned for generating a rotation torque for driving the fastener when the operation member is at the first position; and the second axis is arranged in vertical to the first axis, a storage is facilitated when the operation member is at the second position; and the second axis is arranged in parallel to the first axis, the operation member is a hollow casing having a groove, the groove has one side opened to form an opening, the combination portion and the connection portion are pivotally combined in the groove, the first position is defined as the second axis being vertical to the first axis and the main body pivots out of the groove from the opening, and the second position is defined as the second axis being in parallel to the first axis and the main body pivots into the groove from the opening; and an indication device disposed between the main body and the operation member for displaying a corresponding torque value.

2. The multifunctional torque wrench of claim 1, wherein at the second position, the driving portion is able to accommodate the fastener for driving the fastener.

3. The multifunctional torque wrench of claim 2, wherein when the second axis is parallel to the first axis, and a longitudinal length of the main body is greater than a longitudinal length of the operation member.

4. The multifunctional torque wrench of claim 1, wherein the combination portion and the connection portion are pivotally connected by a pivot device.

5. The multifunctional torque wrench of claim 4, wherein the pivot device includes a shaft and an elastic member, the operation member having a groove, a length of the shaft being greater than a width of the groove, the shaft being combined in a through hole of the operation member, with two ends of the elastic member resisting against the shaft and the operation member, such that the shaft slides along an axial direction with respect to the through hole.

6. The multifunctional torque wrench of claim 5, wherein the shaft has a protrusion section radially protruding and an avoidance section being concave with respect to the protrusion section; the main body has a pivot hole disposed on the combination portion, so that the shaft passes through the pivot hole; the main body has a plurality of position limiting grooves for receiving the protrusion section, such that the plurality of position limiting grooves are applied for engaging and fixing the protrusion section at the first position and the second position, respectively; when the shaft slides along the axial direction, the avoidance section faces the corresponding position limiting groove for cancelling an engagement between the main body and the operation member, so that the main body is able to pivot into or out of the groove with respect to the operation member.

7. The multifunctional torque wrench of claim 6, wherein the main body is a rod body having a sectional profile formed in a hexagonal shape, and the combination portion is formed of one end of the main body which is curved to form the pivot hole; the plurality of position limiting grooves are formed on an inner side of the pivot hole on the combination portion.

8. The multifunctional torque wrench of claim 6, wherein the shaft is formed by a combination of a first shaft section and a second shaft section, one of the first shaft section and the second shaft section having one end provided with a protrusion portion, and the other one of the first shaft section and the second shaft section having one end provided with a concave portion, such that the protrusion portion and the concave portion are both formed in a non-circular shape and combined in a concave-convex combination manner; the first shaft section and the second shaft section are combined through the concave portion and the protrusion portion.

9. The multifunctional torque wrench of claim 8, wherein the operation member has a first sleeve ring and a second sleeve ring disposed on two opposites sides in the groove; in the groove, two ends of the shaft pass through the first sleeve ring and the second sleeve ring, respectively; the shaft has a block portion radially protruding on the first shaft section and placed in the first sleeve ring; the elastic member in the first sleeve ring has two ends resisting against the block portion and the operation member, respectively.

10. The multifunctional torque wrench of claim 1, wherein the indication device has a first indication portion arranged between the main body and the operation member; when the twisting portion of the main body is twisted, the first indication portion moves to display the corresponding torque value; the first indication portion includes a pointer and a window, the pointer disposed in the groove and having one end pivotally connected to the main body, with another end of the pointer having an indication end, the window disposed on the operation member and having an aperture and a mark potion, the mark portion having the torque value marked thereon, the indication end protruding through the aperture and resisting against the mark portion;

when the operation member is at the first position for turning the main body, the indication end points at the corresponding torque value on the mark portion.

11. The multifunctional torque wrench of claim 10, wherein the indication device has an external member, and the main body includes an adjustment seat rotatably disposed on the external member in adjacent to the combination portion, with one end of the pointer pivotally connected to the adjustment seat; the adjustment seat rotates with respect to the main body to be positioned, so as to adjust a position on the mark portion at which the indication end points.

12. The multifunctional torque wrench of claim 11, wherein the operation member has a groove, and the pointer is in the groove and resisted by a resilient plate, such that the indication end is pressed upon the mark portion.

13. The multifunctional torque wrench of claim 12, wherein the resilient plate has one end connected with the pointer and raised along a slanting direction, with another end of the resilient plate contacting the extension portion for resisting against the pointer.

14. The multifunctional torque wrench of claim 12, wherein the resilient plate has one end connected with the extension portion and raised along a slanting direction, with another end of the resilient plate contacting the pointer for resisting against the pointer.

15. The multifunctional torque wrench of claim 10, wherein the operation member has a notch formed on the extension portion away from the connection portion, so that at the second position, the driving portion is exposed out of the operation member from the notch.

16. The multifunctional torque wrench of claim 15, wherein the indication device has a second indication portion disposed between the main body and the operation member; when the twisting portion of the main body is twisted, the second indication portion moves to display the corresponding torque value; the second indication portion includes a mark portion and an indicator, the mark portion disposed on a portion of the driving portion exposed from the notch, and the indicator disposed on one end of the operation member having the notch; when the driving portion is exposed from the notch at the second position, and the operation member turns the main body at the second position to generate the torque, the indicator points at the corresponding torque value on the mark portion.

17. A multifunctional torque wrench, comprising:

a main body having a driving portion, a combination portion, and a twisting portion disposed between the driving portion and the combination portion, the main body having a first axis passing through the driving portion, and the driving portion driving a fastener about the first axis;

an operation member having a connection portion and an extension portion connected with the connection portion, the connection portion connected with the combination portion of the main body, the operation member being switched between a first position and a second position, the extension portion extending along a second axis, wherein the main body is turned for generating a rotation torque for driving the fastener when the operation member is at the first position and the second axis is arranged in vertical to the first axis, a storage is facilitated when the operation member is at the second position, the second axis is arranged in parallel to the first axis; and an indication device disposed between the main body and the operation member for displaying a corresponding torque value;

wherein the combination portion and the connection portion are pivotally connected by a pivot device; and wherein the pivot device includes a shaft and an elastic member, the operation member having a groove, a length of the shaft being greater than a width of the groove, the shaft being combined in a through hole of the operation member, with two ends of the elastic member resisting against the shaft and the operation member, such that the shaft slides along an axial direction with respect to the through hole.

18. A multifunctional torque wrench, comprising:

a main body having a driving portion, a combination portion, and a twisting portion disposed between the driving portion and the combination portion, the main body having a first axis passing through the driving portion, and the driving portion driving a fastener about the first axis;

an operation member having a connection portion and an extension portion connected with the connection portion, the connection portion connected with the combination portion of the main body, the operation member being switched between a first position and a second position, the extension portion extending along a second axis, wherein the main body is turned for generating a rotation torque for driving the fastener when the operation member is at the first position and the second axis is arranged in vertical to the first axis, a storage is facilitated when the operation member is at the second position, the second axis is arranged in parallel to the first axis; and an indication device disposed between the main body and the operation member for displaying a corresponding torque value;

wherein the indication device has a first indication portion arranged between the main body and the operation member; when the twisting portion of the main body is twisted, the first indication portion moves to display the corresponding torque value; the first indication portion includes a pointer and a window, the pointer disposed in the groove and having one end pivotally connected to the main body, with another end of the pointer having an indication end, the window disposed on the operation member and having an aperture and a mark potion, the mark portion having the torque value marked thereon, the indication end protruding through the aperture and resisting against the mark portion; when the operation member is at the first position for turning the main body, the indication end points at the corresponding torque value on the mark portion.

* * * * *